US006260391B1

(12) United States Patent
Rippe

(10) Patent No.: US 6,260,391 B1
(45) Date of Patent: Jul. 17, 2001

(54) LAUNDRY CENTRIFUGE, IN PARTICULAR FOR AN AUTOMATED WASHING RANGE

(75) Inventor: Hans-Joachim Rippe, Hilgermissen (DE)

(73) Assignee: Pharmagg Systemtechnik GmbH, Hoya (DE)

( * ) Notice: Subject to any disclaimer, the term of this patent is extended or adjusted under 35 U.S.C. 154(b) by 0 days.

(21) Appl. No.: 09/345,681

(22) Filed: Jun. 30, 1999

(30) Foreign Application Priority Data

Jul. 3, 1998 (DE) ..... 198 29 874

(51) Int. Cl.[7] ..... D06F 29/02

(52) U.S. Cl. ..... 68/210; 34/58; 34/236; 68/25

(58) Field of Search ..... 68/210, 25, 23 R, 68/24, 142; 34/58, 236

(56) References Cited

U.S. PATENT DOCUMENTS

| | | | | |
|---|---|---|---|---|
| 425,000 | * | 4/1890 | Royster | 68/142 |
| 2,138,858 | * | 12/1938 | Hjelm | 68/25 |
| 2,609,100 | * | 9/1952 | Vitale . | |
| 2,895,232 | * | 7/1959 | Tann | 68/142 X |
| 3,146,196 | * | 8/1964 | Bochan et al. | 68/24 X |
| 3,199,319 | * | 8/1965 | Lowes | 68/210 |
| 3,316,658 | * | 5/1967 | Strike . | |
| 3,328,984 | | 7/1967 | Lowes . | |
| 3,357,213 | * | 12/1967 | Herbertz | 68/210 |
| 3,417,582 | | 12/1968 | Hertig et al. . | |
| 3,742,738 | * | 7/1973 | Frotriede | 34/236 X |
| 3,899,835 | | 8/1975 | Meyer . | |
| 4,360,431 | | 11/1982 | Little . | |
| 4,771,615 | * | 9/1988 | Fukuzawa et al. | 68/23 R |
| 4,941,333 | * | 7/1990 | Blessing | 68/24 X |

FOREIGN PATENT DOCUMENTS

| | | | | |
|---|---|---|---|---|
| 1232076 | * | 1/1967 | (DE) | 68/25 |
| 25 48 327 | | 5/1977 | (DE) | D06F/58/00 |
| 38 19 532 | | 12/1989 | (DE) | B04B/11/00 |
| 42 19 536 | | 12/1993 | (DE) | D06F/49/00 |

* cited by examiner

*Primary Examiner*—Philip R. Coe
(74) *Attorney, Agent, or Firm*—Technoprop Colton LLC

(57) ABSTRACT

Conventional laundry centrifuges are loaded with laundry in a upwardly slanted position, spin-dry in the same position and are then swiveled to an oblique downward angle to unload.

Figure 1:
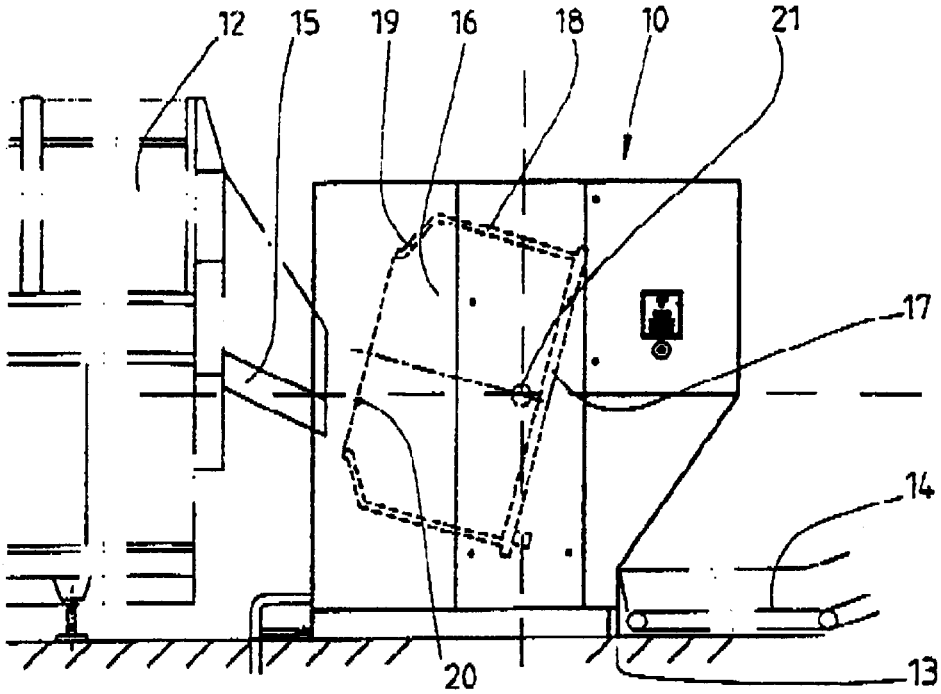

The drum (16) of the centrifuge according to the invention receives the laundry in an upwardly slanted position, spin-dries in an upright position and swivels from that position to a downwardly directed position to unload the laundry.

34 Claims, 4 Drawing Sheets

LAUNDRY CENTRIFUGE, IN PARTICULAR FOR AN AUTOMATED WASHING RANGE

The invention relates to a laundry centrifuge, in particular for connecting to the end of an automated washing range or to a transfer system, with a spin driven drum that receives the laundry through an opening, it being possible to alter the position of the opening by a swiveling movement at least of the drum in such a way that the opening and thus the drum is directed sideways or downwards or in a position in between for unloading the laundry (unloading position) and that for loading the drum with laundry (loading position) the drum assumes a position different from the unloading position, in particular directed to the side or directed somewhat upwardly with respect to the sideways-directed position.

Centrifuges used for automated washing ranges receive the laundry in a position in which a plane formed by the opening is upwardly slanted from the vertical by approximately 8° to 12°. The laundry enters the opening of the drum along a slide. After load, the laundry is spun, specifically in the loading position of the drum. Since the opening is directed to the side it must be covered. Otherwise, there would be the risk that the next batch of laundry might slide into the spinning drum or that laundry could be spun out of the drum.

For unloading the laundry, the drum of known centrifuges is tipped upwards with its horizontal swivel axis located near an upper corner above the laundry opening, with the opening directed obliquely downwards after the tipping action. Unloading is done by rotating the drum at a low speed. The laundry falls out of the opening onto a transport system located below and is conveyed away under the drum. Due to the described pivoting action the known centrifuge requires a large and unobstructed height. The space under the centrifuge for conveying away the laundry is relatively narrow.

The problem of the present invention is to create a laundry centrifuge which is simple in design yet which offers added operational safety.

The laundry centrifuge according to the invention is characterized in that the drum assumes an approximately upright position for spin-drying (spin-drying position) with its opening pointing upwards. Thus, after being loaded the drum is brought into its spin-drying position. During spinning, the opening remains pointing upwards. A cover is therefore not absolutely necessary. The unbalanced forces arising during spinning are also more manageable.

In an advantageous development the unloading position and the loading position of the drum lie on different sides of the spin-drying position. After spinning, the drum is again pivoted or tilted until it attains the unloading position. The process of conveying away the laundry is also much simpler, since the laundry does not have to be conveyed under and past the centrifuge. The swivel axis of the drum is preferably horizontal, running near the bottom of the drum, approximately between the latter and one-third of the drum height. This results in a favorable disposal of space by the centrifuge for all necessary drum positions.

Also of significance is the mounting of the drum in the fashion of a pendulous hydroextractor, with a pendulum radius or up to 150 mm, preferably 30–40 mm. As a result the drum has a relatively high center of gravity. This results in an extremely low natural resonance of the drum of about 25–35 r.p.m, in particular of no more than 75 r.p.m. The low natural resonance facilitates the spreading of the laundry with the subsequent unbalance test. Usually the drum is accelerated slowly. The laundry first spreads out on the walls of the drum. The drum then approaches its natural resonance range. As soon as a major unbalance error occurs, the drum is braked until the laundry has loosened, whereupon the drum is accelerated once again. The low natural frequency diminishes the amount of time required for any second start of the drum if any unbalance error has been determined. Its design as a pendulous hydro-extractor with a relatively high center of gravity facilitates the means for the suspension and mounting of the drum. Special measures for the equalization of damping or unbalance are not required. Instead, there is an inherent tolerance for a certain degree of pendulum radius.

The drum exhibits a specific ratio of diameter to height, or the diameter to the distance between the swivel axis and drum opening. As a result, the drum diameter is greater than that of comparable known drums having the same holding capacity. The laundry cake is thereby thinner than that in known drums. As a result, residual moisture is equally distributed in the batches of laundry.

Provided on the inner surface of the drum shell is a fine-meshed covering, in particular a gauze. The drum shell is usually perforated. Frotté is pressed into the holes and is difficult to remove after spin-drying. The fine-meshed covering prevents such material from being pressed into the openings of the drum shell and makes it easier to loosen the drum shell and unload its contents.

Figure 2:
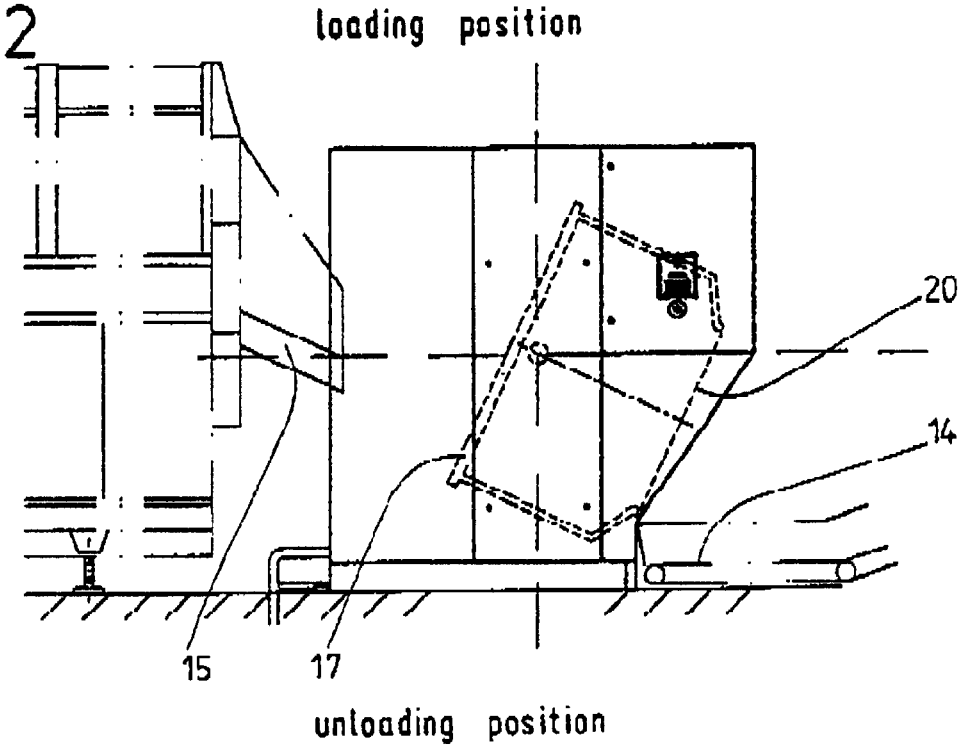
Figure 3:
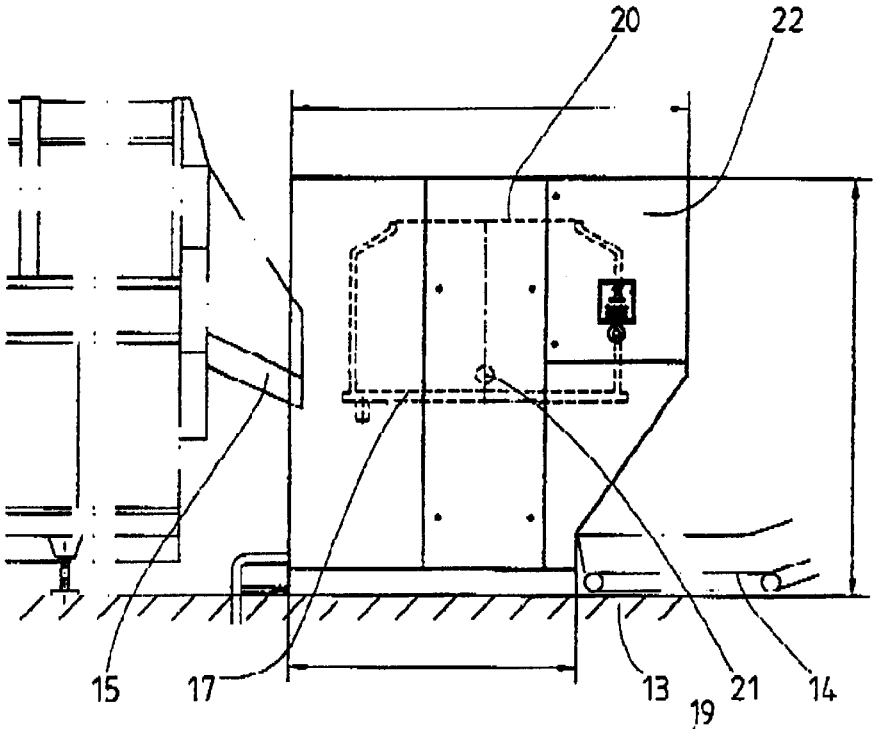
Figure 4:
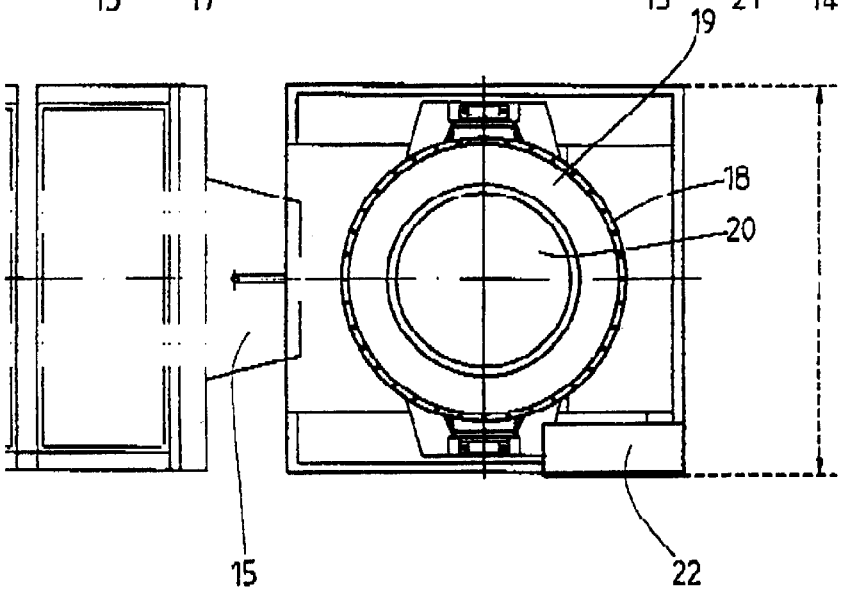

Further features of the invention can be taken from the claims and the remaining description. Exemplary embodiments of the invention are described below with the help of drawings, which show the following:

FIG. 1 Side view of a laundry centrifuge in a wash range in its loading position FIG. 2 the laundry centrifuge according to FIG. 1, but in its unloading position, FIG. 3 the laundry centrifuge according to FIGS. 1 and 2, but in its spin-drying position, FIG. 4 the laundry centrifuge in a position according to FIG. 3, but seen in top view, FIGS. 5 to 8 the laundry centrifuge in positions according to FIGS. 1 to 4, but with additional details.

A centrifuge 10 follows a washing range 12 or another loading system. Downstream of the centrifuge 10 is a discharge conveyor 14 running slightly above the foundation 13. Laundry coming from the washing range 12 enters the region of the centrifuge 10 through an obliquely slanted hopper or down a slide 15.

The centrifuge 10 has a drum 16 which can assume different positions and which is provided with a circular bottom wall 17, a revolving drum shell 18, a conical side strip 19 connected thereto and pointing inwards, and an opening 20 located opposite the bottom wall 17. The drum 16 is tilted along a horizontal axis 21 which lies transverse to the washing range 11.

The different positions of the drum 16 are illustrated in FIGS. 1 to 3. In its loading position the opening 20 faces the slide 15. In this position the imaginary line formed by the opening 20 is tilted upward about 0–10° from the vertical. The swivel axis 21 lies at approximately the same height of the slide 15 or slightly higher. The actual tilt of the drum 16 can be precisely adapted to the individual conditions of the loading system. It is only important that the laundry is loaded into the drum 16 in a manner which is as quick and simple as possible.

Spin drying of the laundry is carried out in the upright position of the drum 16 according to FIG. 3. During spinning the opening 20 faces upwards. This greatly simplifies the design of the centrifuge 10. An additional closure for the drum 16 is not necessary since laundry can neither escape nor enter the spin-dryer when it is running. This arrangement facilitates the mounting of the drum.

To unload the drum 16 it is tilted over to the unloading position according to FIG. 2. In this position the opening 20 points downward at an oblique angle. The imaginary plane of the opening is tilted downward by about 25° from the vertical. The angle of inclination can also be adjusted here to conform to actual conditions. Particularly advantageous is the loading of laundry on one side and its unloading on the opposite side in the direction of the washing range. In the process the drum is pivoted up from a sideways position into the upright spin-drying position and tilted further into a sideways—or downwardly directed—position.

If the available installation space is high enough, the unloading position can also be the mirror-inversion of the position shown in FIG. 2 (inverting in the vertical direction). The unloading position would then be reached by pivoting out of the spin-drying position and through the loading position, the discharge conveyor 14 must then be repositioned appropriately.

Arranged in the drum, i.e. on the inner surface of the drum shell is a fine-meshed gauze. The drum shell is usually perforated so that water can be discharged from the drum. Under unfavorable circumstances laundry of frotté material remains stuck to the side of the drum shell and does not fall off the drum shell when the drum comes to a stop. This disadvantageous effect is prevented by the fine-meshed gauze.

The laundry is introduced into the spinning or stopped drum 16 in the loading position according to FIG. 1, for instance by means of the slide 15. The transfer of heavier goods require a greater rotational speed than that for lighter goods in order to achieve an optimal distribution of laundry. The g-factor can be actively altered or is automatically adaptable by means of the available converter control of the drum drive. In fact, it may be advisable to set the transfer rotational speed to "0" depending on the type of laundry and manner of processing it.

The water running out of the laundry placed into the drum is removed through a drain, stored in a water collecting basin and fed back to the laundering process or to a recovery system. After the laundry has been loaded and a freely-defined interval for the transfer rotational speed has elapsed, the rotational speed is gradually increased, thus generating a greater g-factor. This procedure depends on the type of laundry goods and their weight. The increase in the rotational speed causes the laundry to be spread evenly onto the drum shell 18.

After completion of the spreading phase and at a rotational speed of approximately 20–40 rpm (with a drum diameter of about 1450 mm) an electronic measuring sensor determines the amount of unbalance and thus the quality of distribution. The rotational speed remains constant for a number of seconds while measurements are taken. If the measuring sensor detects an unbalance through the measurement of the oscillation of the centrifuge, the spreading rotational speed is again reduced to the point where the goods fall off the drum shell 18. The rotational speed is again increased and the unbalance detection procedure is carried out once more.

The drum 16 or the centrifuge 10 is supported such that its natural resonance lies in the range of the rotational speed for loading the laundry or slightly above it. Any unbalance can therefore be detected very quickly. This can save time inasmuch as the machine has to be braked whenever an unbalance is detected. Specially-designed shock absorber systems are not necessary but may be provided. The low natural frequency is also achieved by the design of the pendulous centrifuge as having a high center of gravity, low restoring forces and a large pendulum radius. The center of gravity of the loaded drum is not corrected by damping systems. Instead the drum is free to find its own center of gravity within the tolerance range of the pendulum radius.

If the unbalanced mass lies in a tolerance range the rotational speed is increased to a higher value (by about 100%) thus completely ensuring that when the drum 16 is rotated in the vertical spin-drying position no laundry goods will detach themselves from the drum shell 18. The drum is moved automatically into the vertical position. The actual process of hydroextraction can begin.

After the drum 16 has been pivoted to an upright position and mechanically secured in place, its rotational speed is increased in a continuous or discontinuous manner, depending on the type of laundry being processed. These speed regulation characteristics can be variably programmed. The duration of the entire process is also individually programmable.

Once the hydroextraction phase is completed, the drum 16 is braked as quickly as possible until it comes to rest. This quick braking action causes the laundry to loosen from the drum. Once the drum 16 has come to a stop, the mechanical fastening is released and the drum is tilted into the unloading position by a frequency-regulated slewing gear.

Once the drum 16 has reached the unloading position it starts to revolve at its unloading speed and the laundry falls onto the discharge belt, a discharge cart or the like. The laundry is then conveyed automatically or manually to the next handling process.

Once the unloading process is completed, the drum 16 returns to the loading position and is ready to receive another batch of laundry.

The geometric dimensions of the drum 16 are displayed such that the available space is optimally used with respect to the tilting process. The drum 16 has a relatively low drum height as measured from the bottom wall 17 to the side strip 19. Its ratio to the drum diameter is approximately 1:2. The distance between the axes 21 and the opening 20 is also relatively short. Its ratio to the drum diameter is approximately 1:1.75. The proportion between the inner surface of the drum shell 18 to the anticipated load is not less than 400 $cm^2$ per kg of dry laundry. This results in a relatively thin laundry cake. Differences in the amount of remaining moisture in individual pieces of laundry are only very slight.

In order to achieve a thin laundry cake a special loading ratio is used (drum volume in liters to the load weight in kg of dry laundry). The load ratio lies in the range from 16:1 to 24:1, which corresponds to about 60–90 kg of dry laundry. An especially good ratio lies at around 20:1. Combined with the flat angle of the drum in the loading position (plane of opening tilted 0–10° to the vertical or upward position) this results in a very good distribution of laundry over the entire drum shell 18 and a relatively uniform thickness in the layer of laundry with the same g-factor and thus uniform residual moisture.

Shown in FIG. 4 is the position of a switch cabinet 22 with a programming panel, see also the upper right section of FIG. 3. The position can be varied. It is also possible to arrange it on the left side.

FIGS. 5 to 8 show the centrifuge 10 in positions corresponding to those in FIGS. 1 to 4. In contrast to the latter, they do not show the washing range 12 and the discharge conveyor. Instead the suspension and mounting of the drum 16 are shown in more detail.

In the present example the centrifuge 10 is mounted on four pneumatic springs. The pneumatic springs located underneath the drum in the loading position according to FIG. 5 have been designated with the number 23, the pneumatic springs arranged opposite them on the other side have been designated with the number 24. In their relative arrangement to each other the pneumatic springs form the corners of a rectangle whose longer side runs parallel to the swivel axis of the drum 16.

The pneumatic springs 23, 24 themselves are arranged on outwardly-directed extensions 25 at the upper end of the legs 26 of two U-shaped supports 27. The pneumatic springs 23, 24 are thus located clearly below the axis 21 and at the same time clearly below the drum 16. The distance from the pneumatic springs 23, 24 to the axis 21 or drum 16 (in the spin-drying position according to FIG. 7) is about 50–100% of the drum height. This results in a center of gravity, which affects the drum's unbalance behavior, that is relatively high. The natural resonance is correspondingly low.

The drum 16 is swiveled about the axis 21 by means of an electric motor 28 arranged in a low position, in the present case below the pneumatic springs 23, 24. The motor 28 drives via an angular gear 29 a drive belt 30 on a belt pulley 31 assigned to the drum axis 21. Motor 28 and gear 29 are mounted on a centrifuge frame 32 which rests on the pneumatic springs 23, 24.

Figure 5:
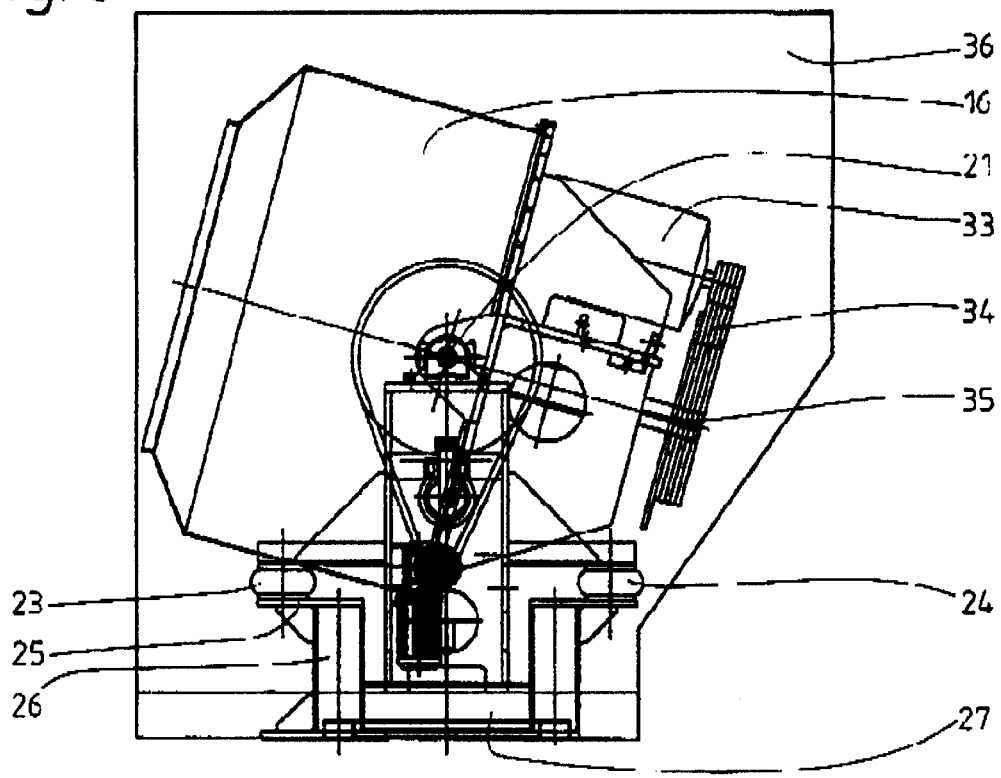

The actual driving of the drum is done by a motor 33 (not shown in FIG. 7) underneath the drum. In FIG. 5 the motor 33 can be seen to the right of the drum 16. Power is transmitted to a drum axis 35 by means of a drive belt 34. Thus the motor is swiveled along with the drum 16 about the axis 21.

Figure 6:
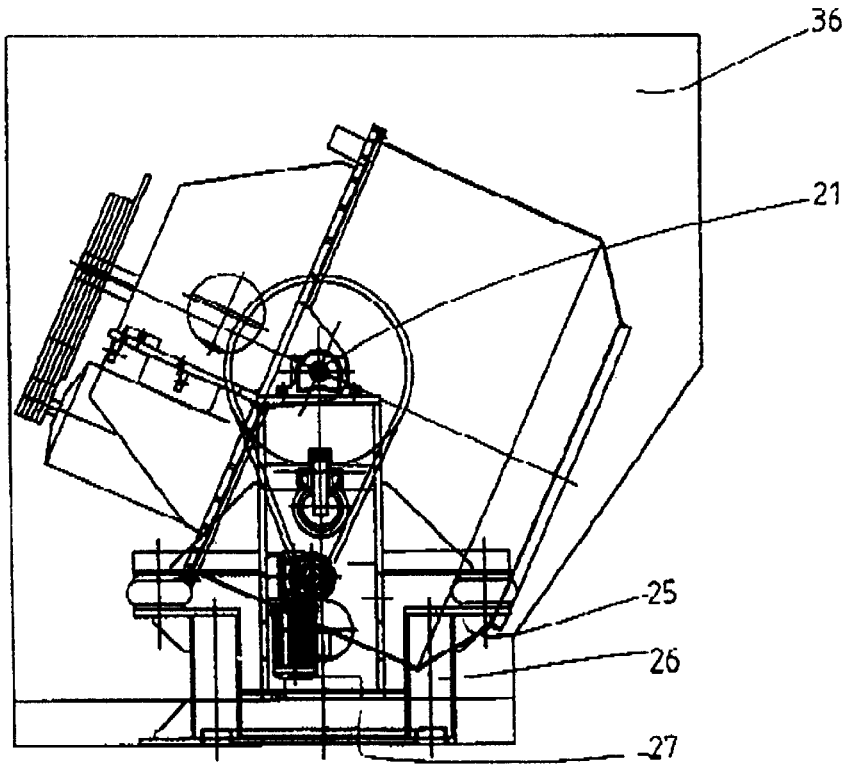
Figure 7:
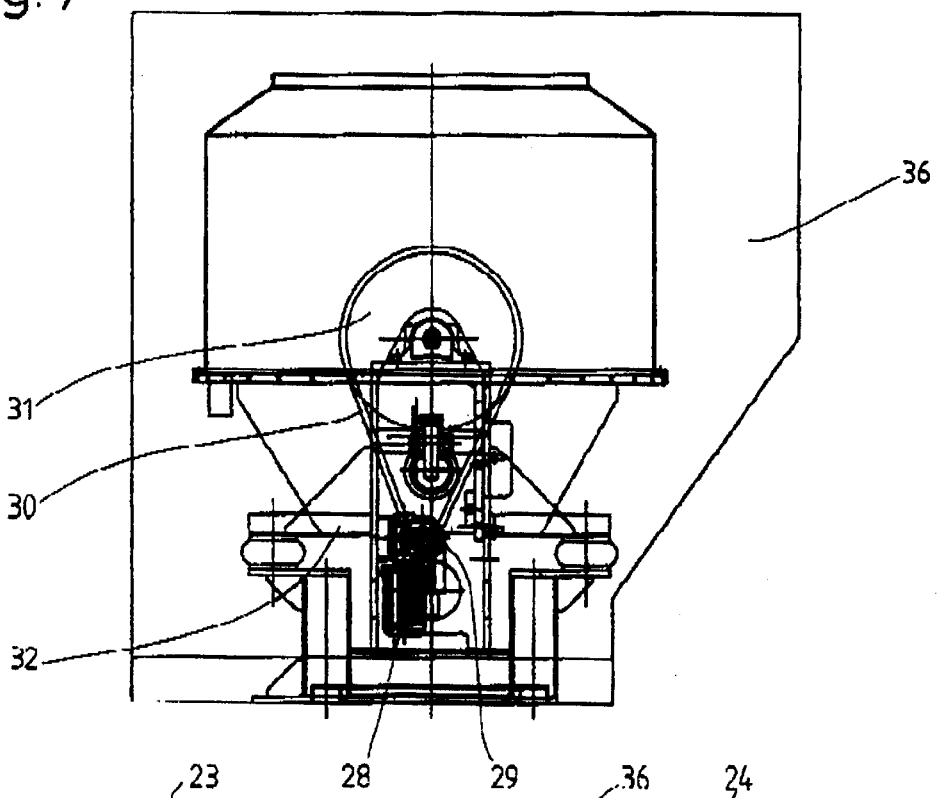
Figure 8:
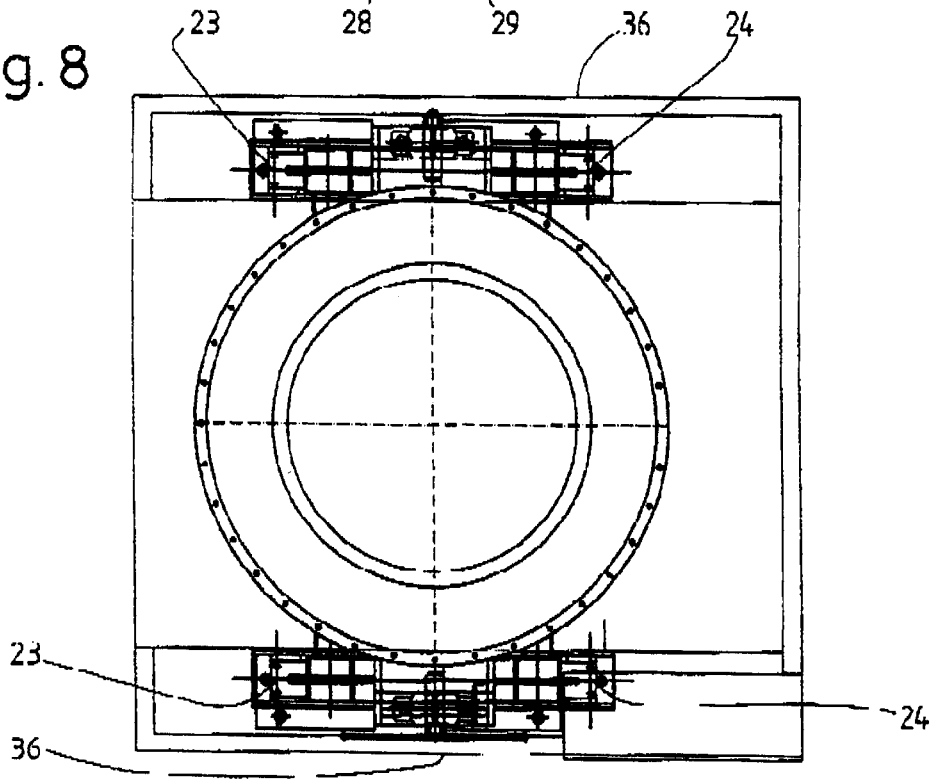

The described arrangement results in special distributions of weight at the individual positions (FIG. 5 to FIG. 7). Naturally, there should be an even load exerted on the pneumatic springs 23, 24 when the hydroextractor is in the spin-drying position according to FIG. 7. Irregularities can occur only due to a tolerated unbalance. In contrast, in the loading position according to FIG. 5 the pneumatic springs arranged on the left bear a greater load because they must absorb practically all of the load exerted by the drum 16 and the drum's contents. The forces occurring during the unbalance check are exerted almost exclusively on pneumatic springs 23. The natural resonance is therefore lower in the loading position than in the spin-drying position due to the arrangement of the suspension points of the centrifuge relative to the drum 16.

The side walls of a centrifuge housing are designated with the number 36. This illustrates quite well the low overall space requirement of the centrifuge. Either in the loading position according to FIG. 5 or in the unloading position shown in FIG. 6 the centrifuge does not extend significantly beyond the silhouette assumed in its spin-drying position shown in FIG. 7.

What is claimed is:

1. Laundry centrifuge for operating at the end of an automated washing range or a transfer system, with a spin-driven drum (16) that receives the laundry through an opening (20), wherein the position of the opening (20) is altered by a swiveling movement at least of the drum (16) in such a way that the opening (20) and thus the drum (20) is directed at an angle between sideways and somewhat downwards for unloading the laundry in an unloading position and that for loading the drum (16) with laundry in a loading position the drum (16) assumes a position different from the unloading position, namely the drum (16) is directed at an angle between sideways and somewhat upwardly with respect to the sideways-directed position, characterized in that the drum (16) assumes an approximately upright position for spin-drying in a spin-drying position with its opening pointing upwards.

2. Centrifuge according to claim 1, characterized in that the loading position and the unloading position of the drum (16) lie on different sides of the spin-drying position.

3. Centrifuge according to claim 1, characterized in that the drum (16) is swiveled about a horizontal axis (21) to change position between loading, spin-drying and unloading.

4. Centrifuge according to claim 3, characterized in that the axis (21) for swiveling the drum (16) runs near a bottom wall (17) of the drum (16) approximately between the bottom wall and ⅓ of the drum height.

5. Centrifuge according to claim 3, characterized in that the ratio of the drum diameter to the distance between axis (21) and drum opening (20) is between approximately 1.6:1 and 1.9:1.

6. Centrifuge according to claim 1, characterized in that the loading position is tilted upward by approximately 0° to 30° from the horizontal.

7. Centrifuge according to claim 6, characterized in that the loading position is tilted upward by approximately 0° to 10° from the horizontal.

8. Centrifuge according to claim 1, characterized in that the unloading position is tilted downward by approximately 10° to 40° from the horizontal.

9. Centrifuge according to claim 8, characterized in that the unloading position is tilted downward by approximately 20° to 30° from the horizontal.

10. Centrifuge according to claim 1, characterized in that the drum (16) is mounted as a pendulum, with a pendulum radius of up to 150 mm.

11. Centrifuge according to claim 1, characterized in that the ratio of the drum diameter to the drum height is between 2:1 and 1:1.8.

12. Centrifuge according to claim 1, characterized in that the drum (16) is mounted with a natural resonance of between approximately 25 r.p.m. and 75 r.p.m.

13. Centrifuge according to claim 12, characterized in that the natural resonance of the drum (16) in the loading position is only slightly greater than the rotational speed required to spread out the laundry.

14. Centrifuge according to claim 13, characterized in that the natural resonance of the drum (16) in the loading position is at most 50 r.p.m. greater than the rotational speed required to spread out the laundry.

15. Laundry centrifuge according to claim 14, characterized in that the ratio of the drum diameter to the drum height is 2:1.

16. Centrifuge according to claim 1, characterized in that a fine-meshed covering is arranged on the inner side of the drum (16).

17. Centrifuge according to claim 16, characterized in that a fine-meshed gauze is arranged on the inner side of the drum (16).

18. Laundry centrifuge for spin-drying laundry, comprising a spin-driven drum (16) that further comprises an opening (20) and a drum floor, the drum (16) loading and unloading laundry through the opening (20), wherein:

a) the drum (16) is swivelably and rotationally mounted within the centrifuge, the opening (20) is located opposite the drum floor, and the position of the opening (20) is alterable by swiveling the drum (20);

b) for loading laundry, the drum (16) is placed in a loading position in which the opening (20) is directed at an angle between sideways or somewhat upwardly with respect to the sideways-directed position;

c) for unloading laundry, the drum (16) is placed in an unloading position in which the opening (20) is directed sideways or downwards or in an intermediate position;

d) for spin-drying, the drum (16) is placed in an approximately upright spin-drying position with the opening (20) pointing upwards; and e) the loading position and the unloading position of the drum (16) are on different sides of the upright spin-drying position.

19. Laundry centrifuge according to claim 18, characterized in that the drum (16) is swiveled about a horizontal axis (21) to change position between the loading position, the upright spin-drying position and the unloading position.

20. Laundry centrifuge according to claim 19, characterized in that the drum (16) further comprises a bottom wall (17) opposite the opening (20) and a drum height, and the axis (21) for swiveling the drum (16) runs near the bottom wall (17), approximately between the bottom wall (17) and ⅓ of the drum height.

21. Laundry centrifuge according to claim 18, characterized in that the loading position is tilted upwards by approximately 0° to 30° from the horizontal.

22. Laundry centrifuge according to claim 21, characterized in that the loading position is tilted upwards by approximately 0° to 10° from the horizontal.

23. Laundry centrifuge according to claim 18, characterized in that the unloading position is tilted downward by approximately 10° to 40° from the horizontal.

24. Laundry centrifuge according to claim 23, characterized in that the unloading position is tilted downward by approximately 20° to 30° from the horizontal.

25. Laundry centrifuge according to claim 18, characterized in that the drum (16) is mounted in the fashion of a pendulum-type hydroextractor.

26. Laundry centrifuge according to claim 18, characterized in that the drum (16) further comprises a drum diameter, and the ratio of the drum diameter to the drum height is at least 1.8:1.

27. Laundry centrifuge according to claim 18, characterized in that the drum (16) further comprises a drum diameter, and the ratio of drum diameter to the distance between the axis (21) for swiveling the drum (16) and the drum opening (20) is between at least 1.6:1 and at most 1.9:1.

28. Laundry centrifuge according to claim 18, characterized in that the drum (16) is mounted with a resonance frequency or natural resonance that is at most 75 r.p.m.

29. Laundry centrifuge according to claim 28, characterized in that the drum (16) is mounted with a resonance frequency of between approximately at least 24 r.p.m. and at most 35 r.p.m.

30. Laundry centrifuge according to claim 18, characterized in that the drum (16) is mounted with a resonance frequency in the loading position that is at most 50 r.p.m. greater than a rotational speed required to spread out laundry when spin-drying laundry.

31. Laundry centrifuge according to claim 18, characterized in that the centrifuge is located at the end of a laundry line selected from the group consisting of automatic laundry washing ranges and laundry transfer systems.

32. Laundry centrifuge for spin-drying laundry, comprising a spin-driven drum (16) that further comprises an opening (20) and a drum floor, the drum (16) loading and unloading laundry through the opening (20), wherein:

a) the drum (16) is swivelably and rotationally mounted within the centrifuge, the opening (20) is located opposite the drum floor, and the position of the opening (20) is alterable by swiveling the drum (20);

b) for loading laundry, the drum (16) is placed in a loading position in which the opening (20) is directed at an angle between 0° and 30° upwards relative to horizontal;

c) for unloading laundry, the drum (16) is placed in an unloading position in which the opening (20) is directed at an angle between 10° and 40° downwards relative to horizontal;

d) for spin-drying laundry, the drum (16) is placed in an upright spin-drying position with the opening (20) is directed at an angle of 90° upwards relative to horizontal; and e) the loading position and the unloading position of the drum (16) are on different sides of the upright spin-drying position.

33. Laundry centrifuge according to claim 32, characterized in that the drum (16) is swiveled about a horizontal axis (21) to change position between the loading position, the upright spin-drying position and the unloading position.

34. Laundry centrifuge according to claim 33, characterized in that the drum (16) rotates about a vertical axis for spin-drying the laundry, wherein the vertical axis is normal to the horizontal axis (21).

* * * * *